US006328026B1

(12) United States Patent
Wang et al.

(10) Patent No.: US 6,328,026 B1
(45) Date of Patent: Dec. 11, 2001

(54) METHOD FOR INCREASING WEAR RESISTANCE IN AN ENGINE CYLINDER BORE AND IMPROVED AUTOMOTIVE ENGINE

(75) Inventors: Yucong Wang; Barry J. Brandt, both of Saginaw, MI (US); John Brice Bible, South Pittsburg, TN (US); Narendra B. Dahotre; John A. Hopkins, both of Tullahoma, TN (US); Mary Helen McCay; Thurman Dwayne McCay, both of Monteagle, TN (US); Fredrick A. Schwartz, Woodbury, TN (US)

(73) Assignee: The University of Tennessee Research Corporation, Knoxville, TN (US)

( * ) Notice: Subject to any disclaimer, the term of this patent is extended or adjusted under 35 U.S.C. 154(b) by 0 days.

(21) Appl. No.: 09/417,699

(22) Filed: Oct. 13, 1999

(51) Int. Cl.[7] ..... F02B 75/08

(52) U.S. Cl. ..... 123/668

(58) Field of Search ..... 123/668, 669; 29/888.06, 888.061

(56) References Cited

U.S. PATENT DOCUMENTS

| | | | |
|---|---|---|---|
| 3,705,758 | | 12/1972 | Haskel . |
| 3,848,104 | | 11/1974 | Locke . |
| 3,855,986 | * | 12/1974 | Wiss ..... 123/668 |
| 3,986,767 | | 10/1976 | Rexer et al. . |
| 4,015,100 | | 3/1977 | Gnanamuthu et al. . |
| 4,017,708 | | 4/1977 | Engel et al. . |
| 4,157,923 | | 6/1979 | Yen et al. . |
| 4,212,900 | | 7/1980 | Serlin . |

(List continued on next page.)

FOREIGN PATENT DOCUMENTS

| | | |
|---|---|---|
| 4126351 | 2/1993 | (DE) . |
| 876870A1 | 4/1998 | (EP) . |
| 279692 | 11/1988 | (JP) . |
| 401083676A | 3/1989 | (JP) . |
| 381082 | 4/1991 | (JP) . |
| 3115587A | 5/1991 | (JP) . |
| 403115531A | 5/1991 | (JP) . |
| 5285686 | 11/1993 | (JP) . |
| 1557193 | 4/1990 | (RU) . |
| 1743770 | 6/1992 | (RU) . |
| WO 95/21720 | 8/1995 | (WO) . |
| WO 97/47397 | 12/1997 | (WO) . |

OTHER PUBLICATIONS

Ayers, et al.; "A Laser Processing Technique for Improving the Wear Resistance of Metals," *Journal of Metals*, Aug. 1981, 19–23.

Belvaux, et al.; "A method for Obtaining a Uniform Non –Gaussian Laser Illumination," *Optics Communications,* vol. 15, No. 2, Oct. 1975, 193–195.

Bett, et al.; "Binary phase zone–plate arrays for laser–beam spatial–intensity distribution conversion," *Applied Optics*, vol. 34, No. 20, Jul. 10, 1995, 4025–4036.

(List continued on next page.)

*Primary Examiner*—Noah P. Kamen
*Assistant Examiner*—Hai Huynh
(74) *Attorney, Agent, or Firm*—Duane, Morris & Heckscher LLP

(57) ABSTRACT

This invention is directed to a method for enhancing the wear resistance of an iron engine cylinder bore comprising laser alloying of the cylinder bore with selected precursors and honing the cylinder bore to a preselected dimension. The present invention is particularly well suited for enhancing the resistance to wear caused by the corrosion caused by automotive ethanol fuel. The present invention is also directed toward an improved automotive engine comprising alloyed cylinder bores with enhanced wear resistance characteristics.

6 Claims, 6 Drawing Sheets

U.S. PATENT DOCUMENTS

| | | | | |
|---|---|---|---|---|
| 4,322,601 | | 3/1982 | Serlin . | |
| 4,434,189 | | 2/1984 | Zeplatynsky . | |
| 4,475,027 | | 10/1984 | Pressley . | |
| 4,480,169 | | 10/1984 | Macken . | |
| 4,495,255 | | 1/1985 | Draper et al. . | |
| 4,535,218 | | 8/1985 | Krause et al. . | |
| 4,617,070 | | 10/1986 | Amende et al. . | |
| 4,638,163 | | 1/1987 | Braunlich et al. . | |
| 4,644,127 | | 2/1987 | La Rocca . | |
| 4,720,312 | | 1/1988 | Fukuizumi et al. . | |
| 4,724,299 | | 2/1988 | Hammeke . | |
| 4,746,540 | | 5/1988 | Kawasaki et al. . | |
| 4,750,947 | | 6/1988 | Yoshiwara et al. . | |
| 4,801,352 | | 1/1989 | Piwczyk . | |
| 4,839,518 | | 6/1989 | Braunlich et al. . | |
| 4,847,112 | | 7/1989 | Halleux . | |
| 4,898,650 | | 2/1990 | Wu et al. . | |
| 4,904,498 | | 2/1990 | Wu . | |
| 4,964,967 | | 10/1990 | Hashimoto et al. . | |
| 4,981,716 | | 1/1991 | Sundstrom . | |
| 4,998,005 | | 3/1991 | Rathi et al. . | |
| 5,032,469 | * | 7/1991 | Merz et al. | 428/662 |
| 5,059,013 | | 10/1991 | Jain . | |
| 5,072,092 | | 12/1991 | Ritcher et al. | 219/121.72 |
| 5,095,386 | | 3/1992 | Scheibengraber . | |
| 5,124,993 | | 6/1992 | Braunlich et al. . | |
| 5,130,172 | | 7/1992 | Hicks et al. . | |
| 5,147,999 | | 9/1992 | Dekumbis et al. . | |
| 5,196,672 | | 3/1993 | Matsuyama et al. . | |
| 5,208,431 | | 5/1993 | Uchiyama et al. . | |
| 5,230,755 | | 7/1993 | Pierantoni et al. . | |
| 5,247,155 | | 9/1993 | Steen et al. . | |
| 5,257,274 | | 10/1993 | Barrett et al. . | |
| 5,265,114 | | 11/1993 | Sun et al. . | |
| 5,267,013 | | 11/1993 | Spence . | |
| 5,290,368 | | 3/1994 | Gavigan et al. . | |
| 5,308,431 | | 5/1994 | Maher et al. . | |
| 5,314,003 | | 5/1994 | Mackay . | |
| 5,319,195 | | 6/1994 | Jones et al. . | |
| 5,322,436 | | 6/1994 | Horng et al. . | |
| 5,331,466 | | 7/1994 | Van Saarloos . | |
| 5,334,235 | | 8/1994 | Dorfman et al. | 75/255 |
| 5,352,538 | | 10/1994 | Takeda et al. . | |
| 5,363,821 | * | 11/1994 | Rao et al. | 123/193.2 |
| 5,387,292 | | 2/1995 | Morishige et al. . | |
| 5,406,042 | | 4/1995 | Engelfriet et al. . | |
| 5,409,741 | | 4/1995 | Laude . | |
| 5,411,770 | | 5/1995 | Tsai et al. . | |
| 5,430,270 | | 7/1995 | Findlan et al. . | |
| 5,446,258 | | 8/1995 | Mordike . | |
| 5,449,536 | | 9/1995 | Funkhouser et al. . | |
| 5,466,906 | | 11/1995 | McCune, Jr. et al. . | |
| 5,484,980 | | 1/1996 | Pratt et al. . | |
| 5,486,677 | | 1/1996 | Maischner et al. . | |
| 5,491,317 | | 2/1996 | Pirl . | |
| 5,514,849 | | 5/1996 | Findlan et al. . | |
| 5,530,221 | | 6/1996 | Benda et al. . | |
| 5,546,214 | | 8/1996 | Black et al. . | |
| 5,563,095 | | 10/1996 | Frey . | |
| 5,614,114 | | 3/1997 | Owen . | |
| 5,643,641 | | 7/1997 | Turchan et al. . | |
| 5,659,479 | | 8/1997 | Duley et al. . | |
| 5,671,532 | * | 9/1997 | Rao et al. | 29/888.061 |
| 5,766,693 | * | 6/1998 | Rao | 427/454 |
| 5,829,405 | * | 11/1998 | Godel | 123/193.2 |
| 5,874,011 | | 2/1999 | Ehrlich . | |
| 5,958,521 | * | 9/1999 | Zaluzec et al. | 427/449 |
| 6,095,107 | * | 8/2000 | Kloft et al. | 123/193.2 |

OTHER PUBLICATIONS

Bewsher, et al.; "Design of single–element laser–beam shape projectors," Applied *Optics*, vol. 35, No. 10, Apr. 1, 1996, 1654–1658.

Breinan et al.; "Processing material with lasers," *Physics Today*, Nov. 1976, 44–50.

Bruno, et al.; "Laserbeam Shaping for Maximum Uniformity and Maximum Loss, A Novel Mirror Arrangement Folds the Lobes of a Multimode Laserbeam Back onto its Center," *Lasers & Applications,* Apr. 1987, 91–94.

Chen, et al.; "The Use of a Kaleidoscope to Obtain Uniform Flux Over a Large Area in a Solar or Arc Imaging Furnace," *Applied Optics*, vol. 2, No. 3, Mar. 1963, 265–571.

Christodoulou, et al.; "Laser surface melting of some alloy steels," *Metals Technology*, Jun. 1983, vol. 10, 215–222.

Cullis, et al.; "A device for laser beam diffusion and homegenisation," J. Phys. E:Sci. Instrum., vol. 12, 1979, 688–689.

Dahotre, et al., "Development of microstructure in laser surface alloying of steel with chromium," *Journal of Materials Science*, vol. 25, 1990, 445–454.

Dahotre, et al., "Laser Surface Melting and Alloying of Steel with Chromium," *Laser Material Processing III*, 1989, 3–19.

Fernelius, et al.; "Design and Testing of a Refractive Laser Beam Homogenizer," *Airforce Writing Aeronautical Laboratories Report*, (AFWAL–TR–84–4042), Sep. 1984, 46 pages.

Frieden; "Lossless Conversion of a Plane Laser Wave to a Uniform Irradiance," *Applied Optics*, vol. 4, No. 11, Nov. 1965, 1400–1403.

Galletti, et al.; "Transverse–mode selection in apertured super–Gaussian resonators: an experimental and numerical investigation for a pulsed $CO_2$ Doppler lidar transmitter," *Applied Optics*, vol. 36, No. 6, Feb. 20, 1997, 1269–1277.

Gori, et al.; "Shape–invariance range of a light beam," *Optics Letters*, vol. 21, No. 16, Aug. 15, 1996, 1205–1207.

Grojean, et al.; "Production of flat top beam profiles for high energy lasers," Rev. Sci. Instrum. 51(3), Mar. 1980, 375–376.

Hella, "Material Processing with High Power Lasers," *Optical Engineering*, vol. 17, No. 3, May–Jun. 1978, 198–201.

Ignatiev, et al.; "Real–time pyrometry in laser machining," *Measurement and Science Technology*, vol. 5, No. 5, 563–573.

"Laser Removing of Lead–Based Paint" Illinois Department of Transportation, Jun. 1992, 26 pages.

Jones, et al.; "Laser–beam analysis pinpoints critical parameters," *Laser Focus World*, Jan. 1993, 123–130.

Khanna, et al.; "The Effect of Stainless Steel Plasma Coating and Laser Treatment on the Oxidation Resistance of Mild Steel," *Corrosion Science,* vol. 33, No. 6, 1992, 949–958.

"New Products" *Laser Focus World*, Aug. 1996, 173.

Lugscheider, et al.; "A Comparison of the Properties of Coatings Produced by Laser Cladding and Conventional Methods," *Surface Modification Technologies V*, The Institute of Materials, 1992, 383–400.

Manna, et al.; "A One–dimensional Heat Transfer Model for Laser Surface Alloying of Chromium on Copper Substrate," *Department of Metallurgical & Materials Engineering*, Indian Institute of Technology, vol. 86, N. 5, May 1995, 362–364.

Mazille, et al.; "Surface Alloying of Mild Steel by Laser Melting of Nickel and Nickel/Chromium Precoatings," *Materials Performance Maintenance*, Aug. 1991, 71–83.
Molian; "Characterization of Fusion Zone Defects in Laser Surface Alloying Applications," *Scripta Metallurgica*, vol. 17, 1983, 1311–1314.
Molian; "Effect of Fusion Zone Shape on the Composition Uniformity of Laser Surface Alloyed Iron," *Scripta Metallurgica*, vol. 16, 1982, 65–68.
Molian; Structure and hardness of laser–processed Fe–0.2%C–5%Cr and Fe–0.2%C–10%Cr alloys; *Journal of Materisla Science*, vol. 20, 1985, 2903–2912.
"Line–Focussing Optics for Multiple–Pass Laser Welding, " NASA Tech Briefs MFS–29976, date unknown.
"Cylindrical Lenses," *Newport Technical Guide*, date unknown, N–65.
"Fused Silica Cylindrical Lenses," *Newport Technical Guide*, date unknown, N–68.
Oswald, et al.; "Measurement and modeling of primary beam shape in an ion microprobe mass analyser," IOP Publishing Ltd., 1990, 255–259.
Renaud, et al., "Surface Alloying of Mild Steel by Laser Melting of an Electroless Nickel Deposit Containing Chromiun Carbides," *Materials & Manufacturing Processes*, 6(2), 1991, 315–330.
Smurov, et al.; "Peculiarities of pulse laser alloying: Influence of spatial distribution of the beam," J. Appl. Phys. 71(7), Apr. 1, 1992, 3147–3158.
"Spawr Integrator," Spawr Optical Research, Inc., Data Sheet No. 512, Jun. 1986.
Veldkamp, et al.; "Beam profile shaping for laser radars that use detecttor arrays," *Applied Optics*, vol. 21, No. 2, Jan. 15, 1982, 345–358.
Veldkamp; "Laser Beam Profile Shaping with Binary Diffraction Gratings," *Optics communication*, vol. 38, No. 5,6, Sep. 1, 1981, 381–386.
Veldkamp; "Laser beam profile shaping with interlaced binary diffraction gratings, " *Applied Optics*, vol. 21, No. 17, Sep. 1, 1982, 3209–3212.
Veldkamp; "Technique for generating focal–plane flattop laser–beam profiles," Rev. Sci. Instru., vol. 53, No. 3, Mar. 1982, 294–297.
Walker, et al.; "Laser surface alloying of iron and 1C–1.4Cr steel with carbon," *Metals Technology*, vol.11, Sep. 1984, 5 pages.
Walker, et al.; "The laser surface–alloying of iron with carbon," Journal of Material Science vol.20, 1985, 989–995.
Wei, et al.; "Investigation of High–Intensity Beam Characteristics on Welding Cavity Shape and Temperature Distribution," Journal of Heat Transfer, vol. 112, Feb. 1990, 163–169.
Charschan, "Lasers in industry," *Laser Processing Fundamentals*, (Van Nostrand Reinhold Company), Chapter 3, Sec. 3–1, 139–145.
Fernelius, et al; "Calculations Used in the Design of a Refractive Laser Beam Homogenizer," *Airforce Writing Aeronautical Laboratories Report*, (AFWAL–TR–84–4047), Aug. 1984, 18 pages.
Jain, et al.; "Laser Induced Surface Alloy Formation and Diffusion of Antimony in Aluminum," *Nuclear Instruments and Method*, vol.168, 275–282, 1980.
Molian; "Estimation of cooling rates in laser surface alloying processes," Journal of Materials Science Letters, vol. 4, 1985, 265–267.
"High Power CW Nd:YAG Laser Transformation Hardening," Hobart Laser Products, 2 pages.
ASM Handbook, vol. 6, Welding, Brazing, and Soldering, 1993.

* cited by examiner

METHOD FOR INCREASING WEAR RESISTANCE IN AN ENGINE CYLINDER BORE AND IMPROVED AUTOMOTIVE ENGINE

BACKGROUND OF THE INVENTION

1. Field of the Invention

This invention is directed to a method for enhancing the wear resistance of a cast iron engine cylinder bore comprising laser alloying of the cylinder bore with selected precursors and honing the cylinder bore to a preselected dimension. The present invention is particularly well suited for enhancing the resistance to wear caused by the corrosion caused by automotive ethanol fuel. The present invention is also directed toward an improved automotive engine comprising alloyed cylinder bores with enhanced corrosive wear resistance characteristics.

2. Description of the Prior Art

For many decades gasoline has been the primary fuel for internal combustion engines used in automobiles and related motor vehicles. Recent concerns about fuel economy and the adverse impact of automotive emissions on air quality have resulted in increased research and development activity in the use of alcohol blended fuels to power internal combustion engines. An example of such fuels is a blend of 85% ethanol and 15% gasoline, known as "E85" automotive fuel.

Automobile manufacturers have developed and tested E85 fueled engines. Engines which have cast iron cylinder bores, and which have been operated with E85 fuel may experience excessive bore wear resulting from the corrosive effects of E85 fuel. This wear problem is particularly acute in North American countries because of the advanced fuel injection technologies used in these countries.

SUMMARY OF THE INVENTION

The present invention is directed toward a method for enhancing the corrosive wear resistance of a cast iron engine cylinder bore used with ethanol-based fuels. The method of the present invention comprises coating the interior surface of the cylinder bore with a precursor comprising alloying elements that will result in enhanced wear characteristics when alloyed with the surface of the cylinder bore, and irradiating a portion of the interior surface of the cylinder bore with a laser at a sufficient energy level and for a sufficient time to melt the precursor and a portion of the cylinder bore substrate and to cause mixing of the melted materials so that the precursor comprising alloying elements is distributed into the interior surface of the bore and alloys with the iron thereat to form an alloyed iron surface layer. Preferred alloying elements which produce enhanced wear characteristics include Ti, Zr Ni—Ti composites and Ni—Zr composites. After irradiating, the present invention comprises honing the interior surface of the cylinder bore to a preselected dimension that leaves the alloyed iron exposed. This treatment not only reduces the wear rate, but results in more consistent and uniform wear.

The present invention is also directed toward an internal combustion engine comprising at least one cast iron cylinder bore, which has an interior surface comprising an alloyed layer integrally formed with the substrate of the bore. These alloyed layers comprise one or more alloying elements which enhance the corrosive wear resistance of said bore, and are preferably selected from the group consisting of titanium, zirconium, nickel-titanium composites, and nickel-zirconium composites.

DESCRIPTION OF THE PREFERRED EMBODIMENTS

The present invention is directed toward a method for enhancing the corrosive wear resistance of a cast iron engine cylinder bore used with ethanol-based fuel. The cylinder bore may be formed in a cast iron engine block, or a cast iron insert in an aluminum engine block. The method of the present invention comprises applying a precursor 40 comprising alloying elements to the interior surface of the cylinder bore 42, (as shown in block 10 of FIG. 1 and in FIG. 2A) so as to provide a coating 34 (see FIG. 4) of alloying elements on the interior surface of the bore. The precursor may comprise a water-based mixing agent containing a suitable binder, such for adhering the alloyed elements to the bore surface.

In a preferred embodiment, the binder will be thixotropic. A binder comprising modified hydrous silicate will be thixotropic.

In another preferred embodiment, the binder will possess a low surface tension. A binder comprising acetylenic diol will possess a low surface tension.

In another preferred embodiment, the binder will comprise a bacteriocide, such as triaza-azoniatricyclodecane chloride.

In another preferred embodiment, the binder has low foaming or antifoaming properties. A binder comprising a silicone emulsion defoamer will possess antifoaming properties. Suitable binders include LISI$^{SM}$ 100 and LISI$^{SM}$ 101, available from Warren Paint and Color Company of Nashville, Tenn., and A-10-Braz Cement, available from Vitta, Inc. of Bethel, Conn.

Figure 3:
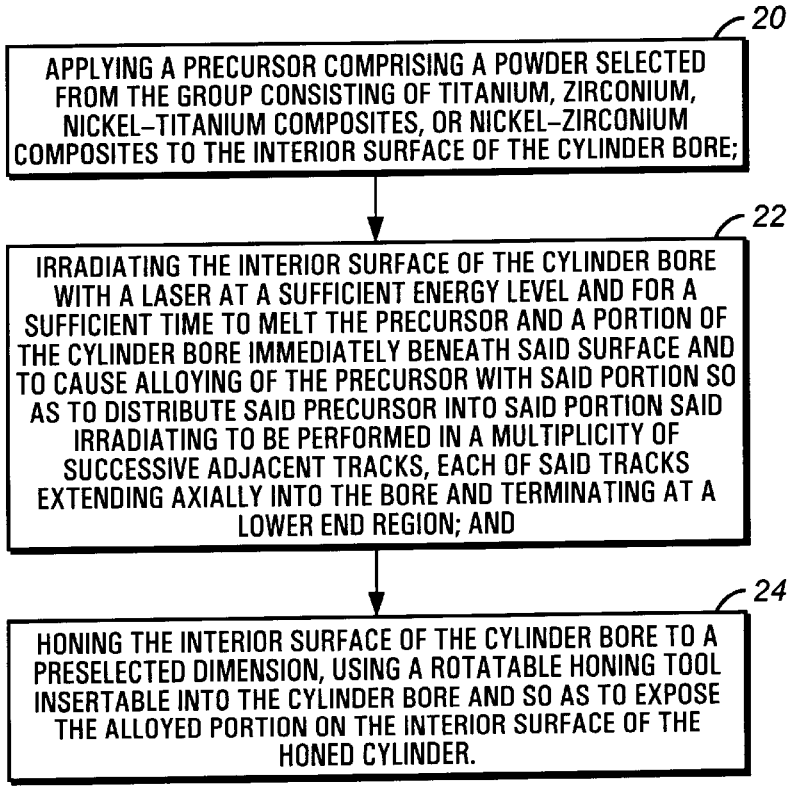
FIG. 3 is a block diagram of a second method embodiment of the present invention.

In a preferred embodiment, the precursor comprises titanium powder, zirconium powder or nickel and titanium composite powder, as shown in block 20 of FIG. 3.

Figure 1:
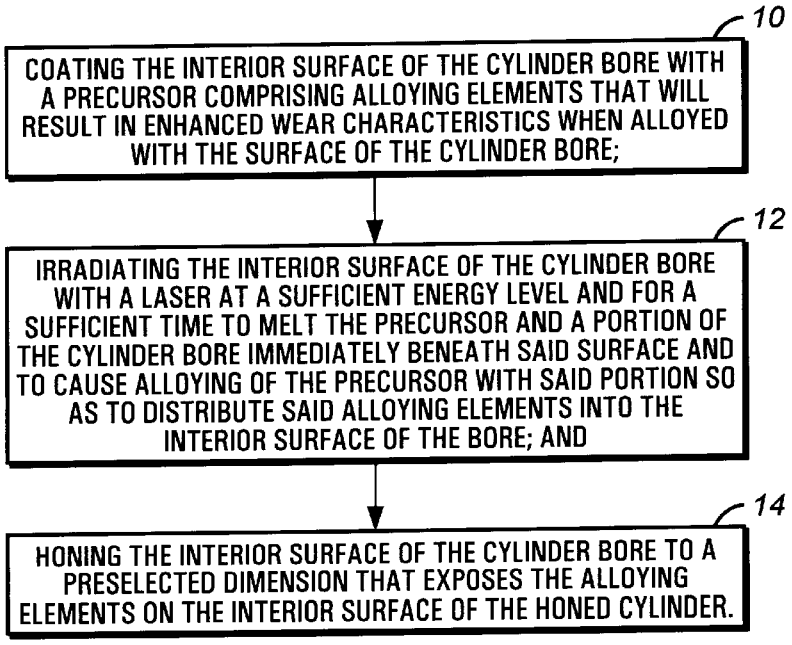
FIG. 1 is a block diagram of a first method embodiment of the present invention.
Figure 2C:
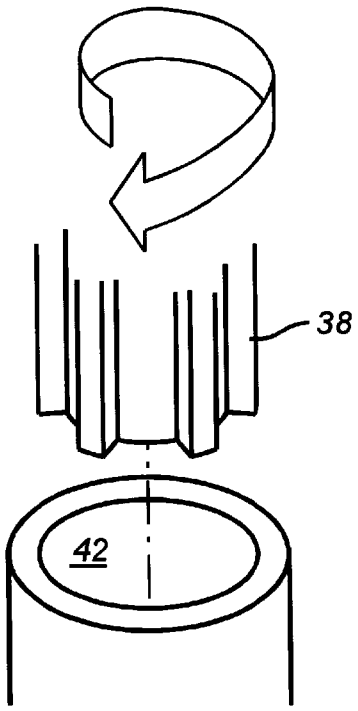
FIGS. 2A–2C are isometric views of a cylinder bore being processed by the method of the present invention.
Figure 2B:
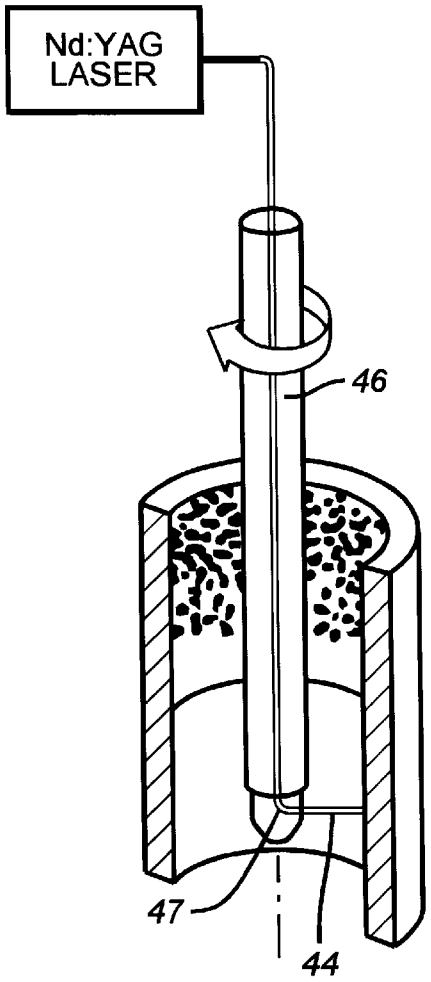
Figure 2A:
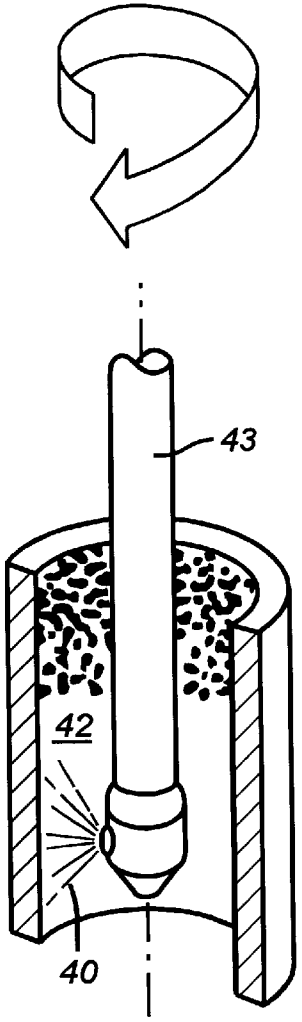

In a preferred embodiment, the precursor is sprayed onto the bore surface with an air gun 43, as shown in FIG. 2A. Spraying preferably occurs at room temperature, as shown in block 10 of FIG. 1.

In one preferred embodiment, the precursor comprises metallic powder that alloys with the iron to produce a surface layer which is resistant to corrosive wear caused by ethanol-based fuels. Particularly preferred alloying elements include titanium, zirconium and nickel-titanium composites which have demonstrated wear resistance at least two times better than cast iron cylinder bores that had been laser hardened, which in turn were at least two times better than cylinder bores which were untreated. The precursor coating 41 preferably has a thickness between 100–250 microns.

The method of the present invention further comprises irradiating a portion of the interior surface of the cylinder bore with a laser 44 at a sufficient energy level, and for a sufficient time, to melt the precursor and a portion of the cylinder bore substrate and to cause mixing of the melted materials so that the alloying elements are distributed into the interior surface of the bore and form an alloyed surface layer up to about 300 micrometers thick for titanium or zirconium alloyed surfaces and up to about 60 micrometers thick for the Ni—Ti alloyed surfaces, as shown in block 12 of FIG. 1 and in FIG. 2B. In a preferred embodiment, the irradiating is performed with a fiber optic beam delivery system 46, as shown in FIG. 2B. Most preferably, the fiber optic beam delivery system is mounted on a periscope beam turning assembly 47, as shown in FIG. 2B. Irradiation intensity is sufficient to alloy the alloying elements with the bore's surface and form an alloyed layer 34 integrally formed with the substrate of the bore, as shown in FIG. 4.

When titanium is the alloying element, the surface layer of the cylinder bore is transformed from a matrix of Pearlite with graphite flakes dispersed throughout to a matrix of Martensite with about 0.1 to about 0.3 volume fraction titanium carbide dispersed throughout, and having a microhardness of about 550 to about 830 Knoop. When zirconium is the alloying element, the surface layer of the cylinder bore is transformed from a matrix of pearlite with graphite flakes dispersed throughout to a matrix of martensite with about 0.08 to about 0.25 volume fraction zirconium carbide dispersed throughout, and having a microhardness of about 550 to about 670 knoop. When nickel-titanium (i.e. 97 wt % Ni—3 wt % Ti) powder is the alloying element, the surface layer of the cylinder bore is transformed from a matrix of Pearlite with graphite flakes dispersed throughout to a matrix of Martensite containing nickel (up to 35 wt %) with a decreasing concentration profile from the bore's surface, and with a small number (less than 3% by vol) titanium carbide particles dispersed throughout and having a microhardness of about 400 to about 500 knoop.

A laser heat-affected zone underlies the alloyed layer and has a thickness as low as about 20–40 microns for the Ni—Ti alloyed layer to about 100–200 microns for the Ti and Zr alloyed layers. Martensite alone, such as is formed by laser hardening only (i.e. without alloying), is not as effective to resist corrosive wear as when Zr or Ti carbides are present. When a high amount of nickel is present in the Martensite, the titanium carbide and zirconium carbide content can be reduced to achieve the same corrosive wear resistance.

Figure 4:
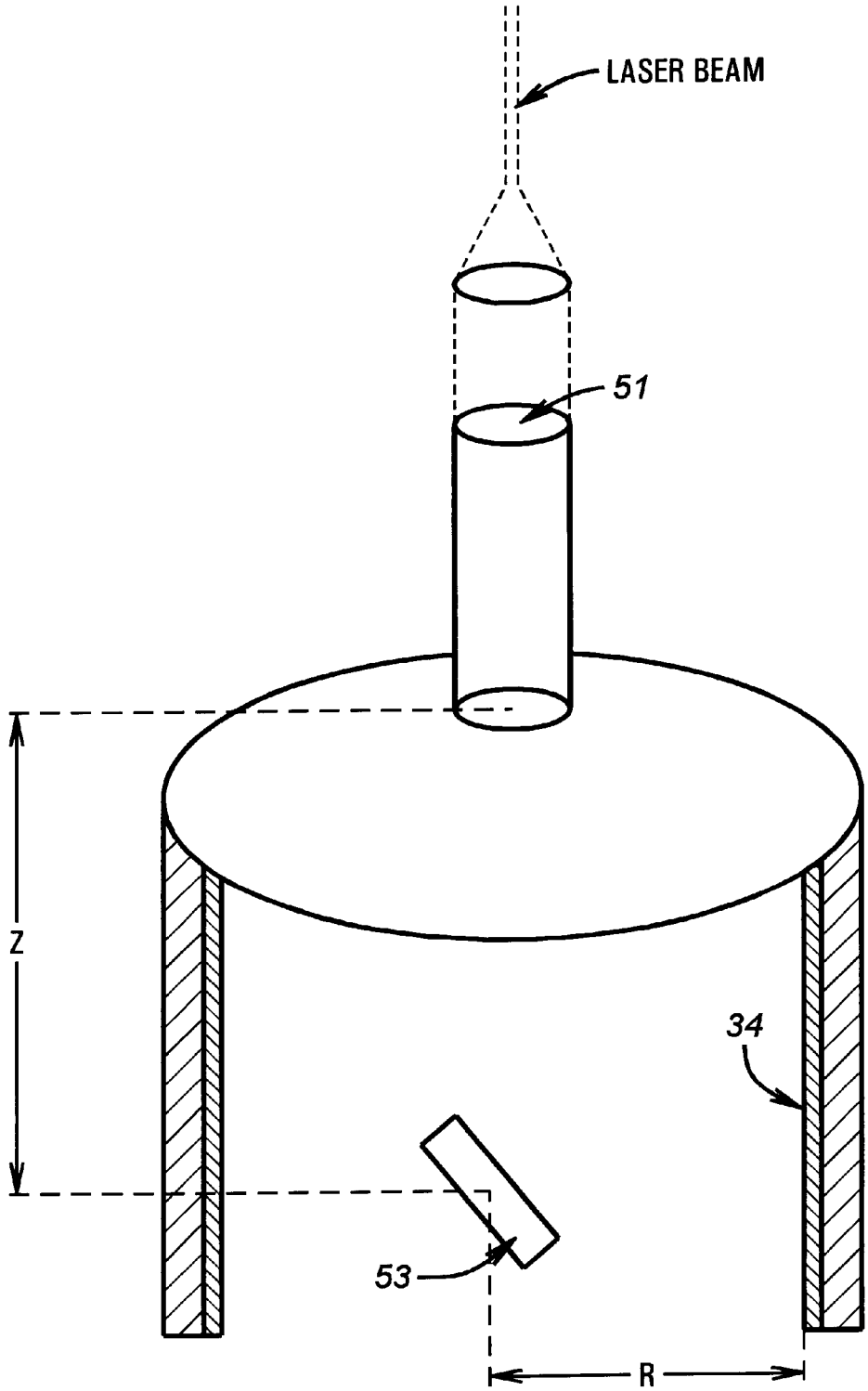
FIG. 4 is a side view of a first laser beam delivery system suitable for use in practicing the present invention.

In another preferred embodiment, the irradiating is performed with an Nd:YAG laser with a fiber optic beam delivery system and periscope beam turning assembly, as illustrated in FIG. 4. The laser may have a power in the range of 1–3 kilowatts and operated at a standoff distance of 100–150 millimeters, as shown in FIG. 4. The term "standoff distance", as used herein, is the distance between the surface being irradiated and the last focusing element. In FIG. 4, the standoff distance is the sum of Z+R, and the last focusing element is lens 51. FIG. 4 also discloses the use of turning a mirror 53 to redirect the laser beam onto the interior surface of the cylinder bore.

In another preferred embodiment, the irradiation is performed with a 3 kilowatt Nd:YAG laser passed through a fiber optic delivery system to a lens assembly 47 which focuses the beam onto the cylinder bore surface. In a preferred embodiment, the laser beam is directed at an angle, θ, of 35° to the surface of the cylinder bore, and is therefore less susceptible to damage.

Figure 6:
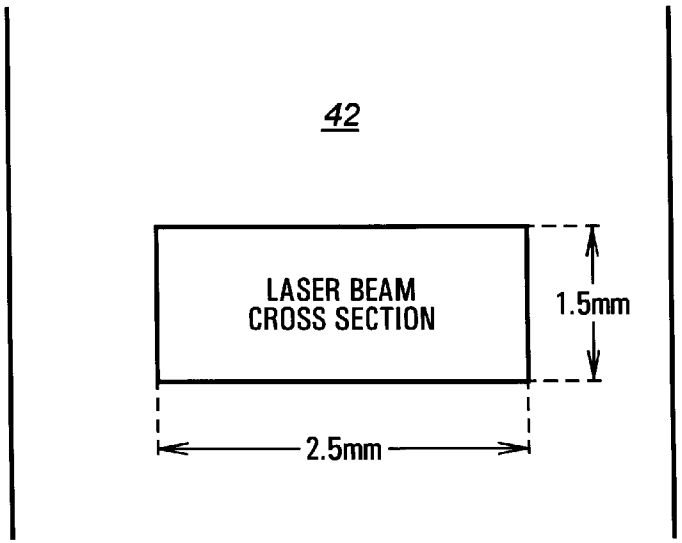
FIG. 6 is a front view of the laser beam on the interior of the cylinder bore.

In one preferred embodiment, the irradiating is performed with a laser beam having (1) a rectangular cross section 50, (as shown in FIG. 6), (2) a cross sectional area of 1.5 square millimeters to 2.5 square millimeters, and (3) a wavelength of 1.06 microns.

A rectangular beam profile having the dimensions described above can be achieved by aligning a spherical lens closest to the beam, a second cylindrical lens closest to the substrate and a first cylindrical lens between the spherical lens and the second cylindrical lens. In one embodiment, the spherical lens should have a focal length of 101.6 millimeters, the first cylindrical lens should have a focal length of 203.2 millimeters, and the second cylindrical lens should have a focal length of 152.4 millimeters. In this same embodiment, the spherical lens and the first cylindrical lens may be spaced apart by five millimeters, and the first cylindrical lens and second cylindrical lens may be spaced apart by 15 millimeters. The spacing of the lens will affect the rectangular beam dimensions.

Figure 5:
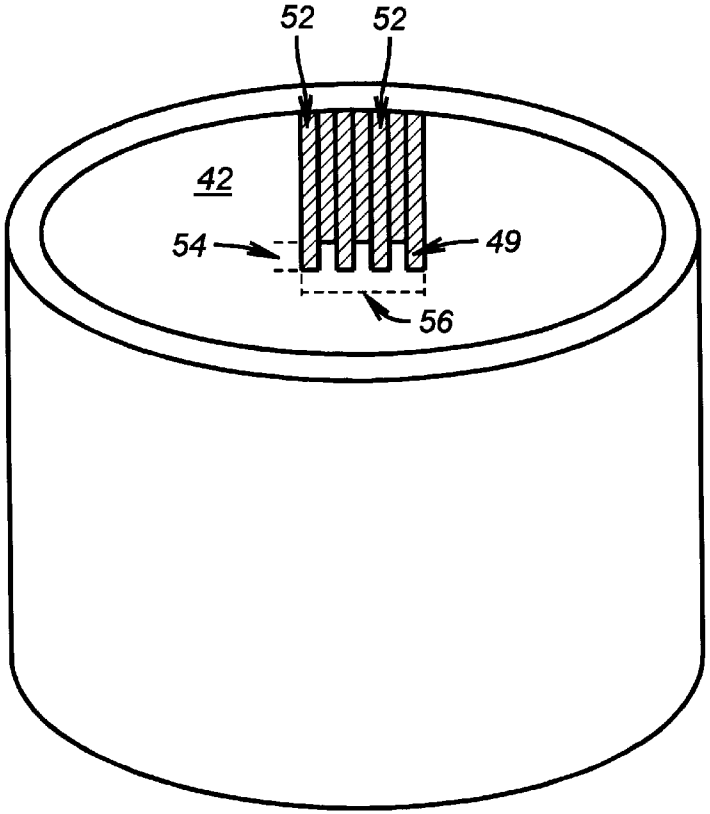
FIG. 5 is an interior view of the cylinder bore during the irradiating step of the present invention.
Figure 7:
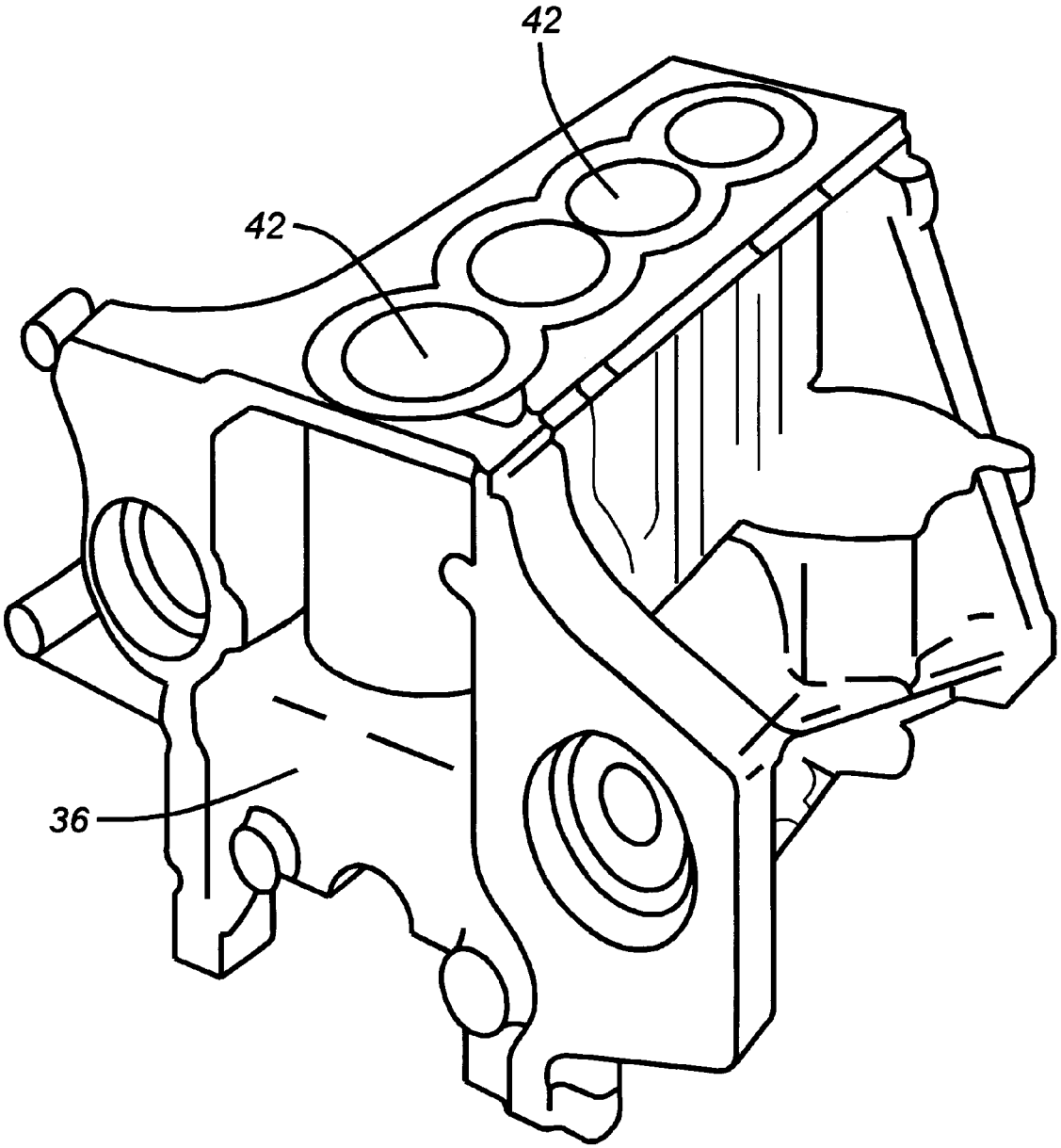
FIG. 7 is an isometric view of an engine of the present invention.
Figure 8:
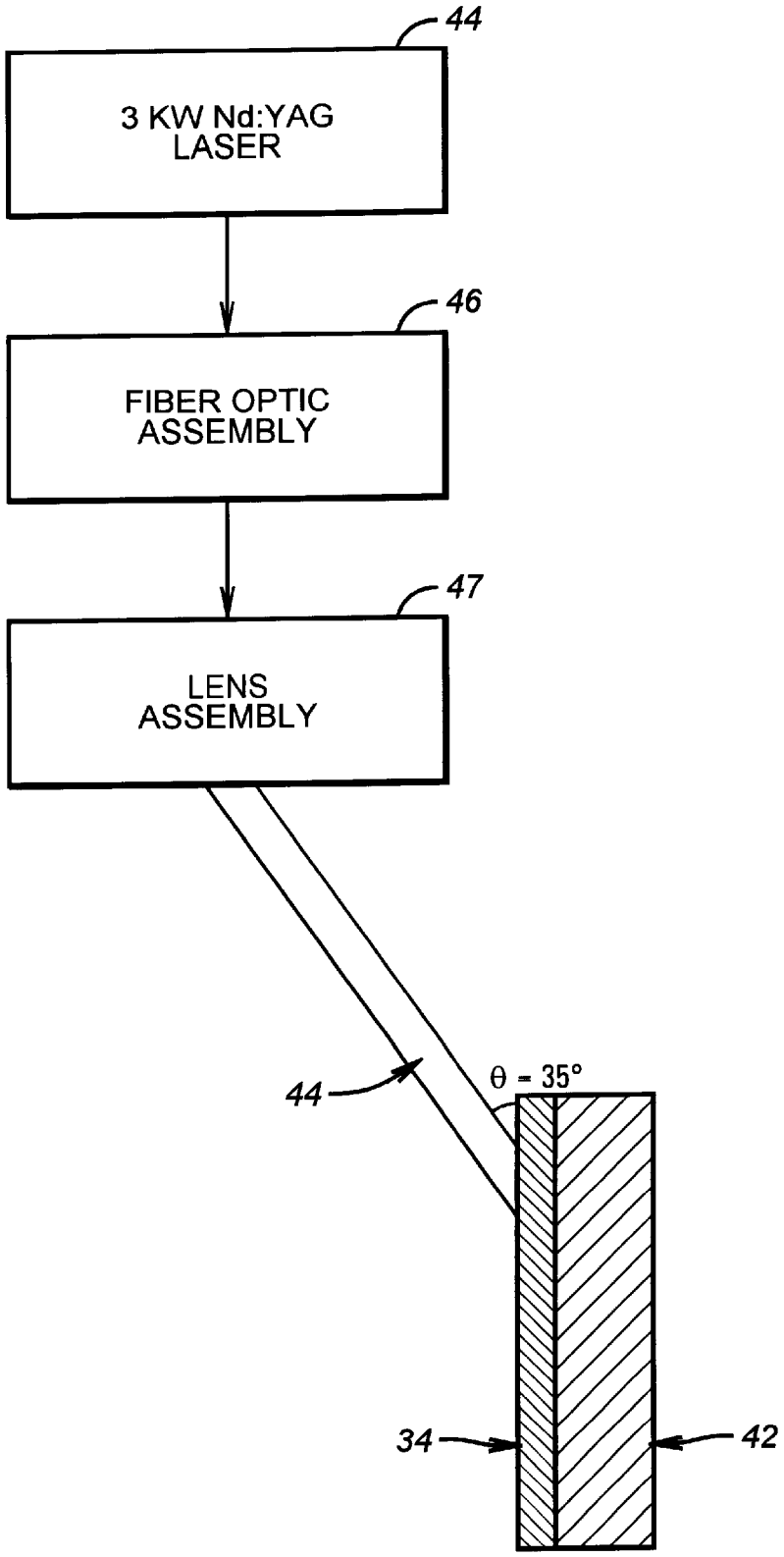
FIG. 8 is a side view of a second laser beam delivery system suitable for use in practicing the present invention.

In a preferred embodiment, the irradiating is performed in a multiplicity of successive adjacent tracks 52 extending axially from the cylinder bore rim to a lower end region 49, as shown in FIG. 5. Though the tracks 52 may extend the full length of the bore, from top to bottom, they may also be provided only near the top (e.g. approximately the top 25 millimeters) of the bore where most of the corrosive wear occurs. A translation rate of 750–1500 millimeters per minute of the laser beam relative to the cylinder bore is suitable for practicing the present invention when operating at a power level of about 1200 to about 2000 watts.

Each of the tracks 52 extends from the top of the cylinder and has a length differential 54 from its adjacent track, as shown in FIG. 5. In a preferred embodiment, this length differential is at least two millimeters. As a result, the lower end regions of the tracks form a saw toothed or zigzagged pattern 56, as shown in FIG. 5. The zigzagged pattern reduces and/or avoids damage from piston ring contact at the interface between the alloyed and nonalloyed regions of the bore. The spacing between the center lines of adjacent tracks is preferably less than the beam width, and each of the tracks has a length in the range of 22–28 millimeters. In a preferred embodiment, the irradiation which forms each track begins in the bore at the lower end of the track and moves upward to the cylinder bore rim.

After irradiating the present invention comprises honing the interior surface of the cylinder bore to a preselected dimension, as shown in block 14 of FIG. 1 and in FIG. 2C. Preferably, the honing is performed using a rotatable honing tool 38, as shown in FIG. 2C, and most preferably in two stages—first with an alumina stone, and second with a diamond stone, as shown in block 14 of FIG. 1.

An automotive internal combustion engine 36, in accordance with the present invention, comprises a multiplicity of iron cylinder bores, each of which comprises an alloyed surface layer 34 integrally formed with the substrate of the bore, and includes one or more alloying elements which enhance the corrosive wear resistance of the iron bore to corrosion.

Comparative tests were conducted to evaluate the effectiveness of laser alloying cast iron cylinder bores to improve corrosive wear resistance. More specifically, three types of samples were bench tested using a Cameron-Plint reciprocating machine that rubbed a nitrided stainless steel piston ring back and forth across the samples under an applied load of 495 MPa (hertzian stress) in the presence of a lubricant mixture comprising 40% E85 fuel, 10% water and 50% 5W30 lubricating oil. The test was conducted at 40° C. for 20 hours. Control samples were of two types—(1) untreated cast iron, and (2) laser-hardened (but not alloyed) cast iron. Test samples were laser-alloyed as set forth above using the following alloying elements (1) Ti, (2) Zr, (3) 48Ni/1A1$_2$O$_3$/1Fe$_2$O$_4$, (4) 40Ni/30Cr/28Mo/2Mn, (5) 47.5Ni/2.5Ti, (6) 48.5Ni/1.5A1, (7) 47Ni/1.5A1/1.5Mn, and (8) Ni.

These tests showed that (1) the untreated samples displayed wear depths (in microns) between about 2.9$\mu$–18.3$\mu$ (mostly ca. 3–8$\mu$), (2) the laser-hardened samples displayed wear depths between about 1.8$\mu$ and 2.5$\mu$, (3) the Ti-alloyed samples displayed wear depths of 1$\mu$ or less, (4) the Zr-alloyed samples display wear depths of about 1$\mu$, and (5) the Ni—Ti samples displayed wear depths of about 1$\mu$. Some others samples fared better than the laser-hardened samples, but less than the preferred Ti, Zr, Ni—Ti samples. In this regard, see Table 1 wherein (1) the wear data reported in the column labeled "L" was wear experienced for tests where the rubbing of the piston ring on the cylinder bore was done in a direction parallel to the direction the laser traveled during alloying (i.e. axially of the bore); and (2) the wear data reported in the column labeled "T" was wear experienced for tests where the rubbing of the piston ring on the cylinder bore was done in a direction transverse to the direction the laser traveled during alloying (i.e. circumferentially of the bore.

TABLE 1

| Sample | Wear Depth (Microns) "L" | "T" |
|---|---|---|
| Untreated | 3.3–18.3 | 2.9–15.4 |
| Laser hardened | 1.8–2.5 | = |
| Ti | <1 | <1 |
| Zr | <1 | <1 |
| Ni—Ti | ~1 | ~1 |
| 40 Ni/30 Cr/28 Mo/2 Mn | 0.8–1.5 | 1.3–2.2 |
| 47 Ni/1.5 Al/1.5 Mn | 2–2.5 | 1.4–1.8 |

TABLE 1-continued

| Sample | Wear Depth (Microns) "L" | "T" |
|---|---|---|
| 48.5 Ni/1.5 Al | 1.5–3 | = |
| 48 Ni/1 Al$_2$O$_3$/1 Fe$_2$O$_4$ | 1.9–3.1 | = |
| 25 ZRB$_2$/25 Ni | 1–1.5 | = |
| Ni | 2–3 | = |

The foregoing disclosure and description of the invention are illustrative and explanatory. Various changes in the size, shape, and materials, as well as in the details of the illustrative construction may be made without departing from the spirit of the invention.

What is claimed is:

1. An improved automotive engine comprising a multiplicity of a cast iron cylinder bores, each of said bores comprising a top and an interior alloyed surface layer extending from the surface of said bore to a predetermined depth into said bore, each of said surface layers comprising at least one alloying element that enhances the corrosive wear resistance of said bore.

2. The engine of claim 1, wherein said alloying elements are selected from the group consisting of titanium, zirconium, nickel-titanium composites and nickel-zirconium composites.

3. The engine of claim 1, wherein said alloyed surface layer comprises titanium or zirconium and has a thickness that is less than or equal to 300 micrometers.

4. The engine of claim 1, wherein said alloyed surface layer comprises nickel-titanium and has a thickness that is less than or equal to 60 micrometers.

5. The automotive engine of claim 4, wherein said alloyed surface layer comprises titanium carbide particles.

6. The automotive engine of claim 5, wherein the volumetric concentration of titanium carbide in said alloyed surface layer is less than three percent.

* * * * *

UNITED STATES PATENT AND TRADEMARK OFFICE

CERTIFICATE OF CORRECTION

PATENT NO. : 6,328,026 B1
DATED : December 11, 2001
INVENTOR(S) : Yucong Wang et al.

It is certified that error appears in the above-identified patent and that said Letters Patent is hereby corrected as shown below:

Title page,
Item [73], Assignee, please add the following assignee:
-- General Motors Corporation, Detroit, MI (US) --

Signed and Sealed this

Tenth Day of December, 2002

JAMES E. ROGAN
*Director of the United States Patent and Trademark Office*